US011533796B2

(12) United States Patent
Zhang et al.

(10) Patent No.: US 11,533,796 B2
(45) Date of Patent: Dec. 20, 2022

(54) SENSOR AND ILLUMINATION LAMP WITH THE SAME

(71) Applicant: Shenzhen Signcomplex Ltd., Shenzhen (CN)

(72) Inventors: WenFeng Zhang, Shenzhen (CN); ShuiWang Li, Shenzhen (CN); TieJun Wu, Shenzhen (CN)

(73) Assignee: SHENZHEN SIGNCOMPLEX LTD., Shenzhen (CN)

( * ) Notice: Subject to any disclaimer, the term of this patent is extended or adjusted under 35 U.S.C. 154(b) by 0 days.

(21) Appl. No.: 17/203,716

(22) Filed: Mar. 16, 2021

(65) Prior Publication Data

US 2021/0204379 A1 Jul. 1, 2021

Related U.S. Application Data

(63) Continuation of application No. PCT/CN2019/106285, filed on Sep. 17, 2019.

(30) Foreign Application Priority Data

Sep. 17, 2018 (CN) ..... 201811081389.1
Sep. 17, 2018 (CN) ..... 201811082923.0
(Continued)

(51) Int. Cl.
*H05B 47/105* (2020.01)

(52) U.S. Cl.
CPC ..... *H05B 47/105* (2020.01)

(58) Field of Classification Search
CPC .. F21V 23/00; F21V 23/0435; F21V 23/0442; F21V 23/045; F21V 23/0464;
(Continued)

(56) References Cited

U.S. PATENT DOCUMENTS

2012/0169805 A1* 7/2012 Bateson ..... B41J 11/0095 356/28
2015/0084503 A1* 3/2015 Liu ..... F21V 23/06 315/51

FOREIGN PATENT DOCUMENTS

CN 201416806 Y 3/2010
CN 103604097 A 2/2014
(Continued)

*Primary Examiner* — Haissa Philogene
(74) *Attorney, Agent, or Firm* — Andrew C. Cheng

(57) ABSTRACT

The present invention provides a sensor and an illumination lamp with the sensor. The illumination lamp with the sensor includes an illumination lamp, a sensor mounting base disposed in the illumination lamp, a sensor electrically connected to the sensor mounting base in a plug-in manner by telescopic conductive pins. A sensing module disposed in the sensor generates a corresponding electrical signal after detecting a triggering signal, to control the lamp on or off. The illumination lamp with the sensor is artistic and practical, without external wiring, complicated mounting steps and wiring connection. Meanwhile, different functional modules, such as a microwave sensing module, an infrared sensing module, a light sensing module, a Bluetooth control module, a WIFI control module, an Internet control module, a smoke sensing module, a fire sensing module and a security monitoring module with special purposes can be selectively mounted in the sensor to realize corresponding functions.

13 Claims, 12 Drawing Sheets

(30) Foreign Application Priority Data

| | | |
|---|---|---|
| Sep. 17, 2018 | (CN) | 201821528459.9 |
| Sep. 17, 2018 | (CN) | 201821528460.1 |
| Dec. 20, 2018 | (CN) | 201811563280.1 |
| Dec. 20, 2018 | (CN) | 201811563944.4 |
| Dec. 20, 2018 | (CN) | 201822146605.8 |
| Dec. 20, 2018 | (CN) | 201822164463.8 |
| Apr. 26, 2019 | (CN) | 201920604734.9 |

(58) Field of Classification Search
CPC ..... F21V 23/0471; F21V 23/06; H05B 47/10; H05B 47/105
See application file for complete search history.

(56) References Cited

FOREIGN PATENT DOCUMENTS

| | | | |
|---|---|---|---|
| CN | 207112558 | U | 3/2018 |
| CN | 207421955 | U | 5/2018 |
| CN | 109084227 | A | 12/2018 |
| CN | 109506225 | A | 3/2019 |
| CN | 109578955 | A | 4/2019 |
| JP | 2014099337 | A | 5/2014 |

* cited by examiner

SENSOR AND ILLUMINATION LAMP WITH THE SAME

TECHNICAL FIELD

The present invention relates to the field of illumination lamps, and more particularly, to a sensor and an illumination lamp with the same.

BACKGROUND

A sensor needs to be connected to an internal circuit of a lamp body by a cable when being mounted on an existing illuminating device, and further needs to be fixed to an illumination lamp by an adapter bracket with a screw.

A sensor lamp plays an important role in facilitating the travel of people and saving energy. When the sensor senses that a moving object passes a specified range set by the sensor lamp, the sensor lamp is turned on. When the moving object crosses the above specified range, the sensor lamp is turned off, thereby saving energy.

According to the traditional sensor lamp, the sensor is generally mounted on a side surface of the lamp body by the following manner. First, a bracket is fixed to the lamp body by a screw, and then, the sensor is fixed to the bracket. After the sensor is fixed, complicated wire connection is further needed. Since the traditional sensor controls an AC input end, it is also necessary to configure a waterproof junction box to realize wiring insulation and protection. Thus, all components forming a sensing device are not only high in cost, but also occupy a large size. In addition, not only are wires scattered around very unsightly, but also the illumination lamp is out of balance due to unequal counterweights caused by the sensor mounted on the side surface. Actually, the market demand is more inclined to voluntary mounting of the sensing device at a client side, but it is difficult to accomplish complicated assembly steps by a client. Moreover, the price of one sensing device usually exceeds one illumination lamp, which is not conducive to the promotion and use of the sensor lamp. Therefore, it is far from achieving the goal of energy saving if there is no large market application.

SUMMARY

In order to overcome the technical defects of the existing sensing device, the present invention provides a sensor and an illumination lamp with the same.

In order to solve the above technical defects, the present invention provides a technical solution as follows: an illumination lamp with a sensor comprises: the illumination lamp, a sensor mounting base and the sensor, wherein the sensor mounting base is mounted on the illumination lamp, the sensor and the sensor mounting base are detachably mounted and connected, a sensing module is arranged in the sensor, and the sensor generates a corresponding electrical signal after detecting a trigger signal to control the illumination lamp to perform a preset control operation.

Preferably, the sensor is provided with a telescopic conductive pin, the sensor mounting base is provided with a contact PCB module, the sensor and the sensor mounting base adopt plug-in connection, and the telescopic conductive pin and the contact PCB module are in pressing contact conduction to realize electrical connection.

Preferably, the sensor comprises at least one modular circuit board, the modular circuit board is a sensor main board, after being triggered, the sensing module transmits a control signal to the sensor main board, then the control signal is transmitted to the telescopic conductive pin by the sensor main board, and the telescopic conductive pin transmits the control signal to the illumination lamp by the contact PCB module in the sensor mounting base to realize function control.

Preferably, the sensing module comprises any one or a combination of more of a microwave sensing module, an infrared sensing module, a light sensing module, a Bluetooth control module, a WIFI control module, an Internet of Things control module, a smoke sensing module, a fire sensing module and a security monitoring module.

Preferably, the illumination lamp with a central sensor comprises a temperature control module, and the temperature control module is integrated in the illumination lamp or disposed in the sensor; the temperature control module comprises a comparator chip and a thermistor, the resistance value of the thermistor changes according to a temperature change, the comparator realizes continuous temperature recognition by judging the resistance value of the thermistor, and when judging that the identification value deviates from a set value, the comparator sends the control signal to adjust power output of the illumination lamp.

Preferably, at least three telescopic conductive pins are disposed, the single telescopic conductive pin comprises any one of a power supply positive electrode conductive pin, a power supply negative electrode conductive pin, a dimming signal positive electrode conductive pin, an auxiliary signal positive electrode conductive pin, and an auxiliary signal negative electrode conductive pin; and the contact PCB module is provided with at least three conductive contact surfaces, and the telescopic conductive pins are matched with the conductive contact surfaces.

Preferably, the single conductive contact surface is circular or arc-shaped; and one of the plurality of conductive contact surfaces is located at a central position and is circular, and the other conductive contact surfaces are located in the circumferential direction with the central position as the center of a circle and are arc-shaped.

Preferably, three telescopic conductive pins are disposed, and comprise a first telescopic conductive pin, a second telescopic conductive pin and a third telescopic conductive pin, the contact PCB module comprises a first conductive contact surface, a second conductive contact surface and a third conductive contact surface, the first telescopic conductive pin, the second telescopic conductive pin and the third telescopic conductive pin are arranged side by side in parallel, the first telescopic conductive pin is in pressing contact with the first conductive contact surface, the second telescopic conductive pin is in pressing contact with the second conductive contact surface, and the third telescopic conductive pin is in pressing contact with the third conductive contact surface; and the second conductive contact surface is circular, and the first conductive contact surface and the third conductive contact surface are both arc-shaped with the second conductive contact surface as the center of a circle.

Preferably, the sensor main board is provided with two or more groups of through holes, the through holes are configured to allow the sensing modules to be welded, and at least two sensing modules are capable of being welded and mounted on the sensor main board at the same time.

Preferably, the sensor comprises a sensor bottom shell, the side wall of the sensor bottom shell is provided with clamping slots, the side wall of the sensing mounting base is provided with clamping blocks, and the docking clamping slots are connected to the docking clamping blocks in a rotary plug-in manner; and the number of each of the clamping slots and the clamping blocks is at least two or more, and the clamping slots and the clamping blocks are the same or different in arrangement angle and size.

Preferably, the inner side wall of the bottom shell of the sensor is provided with a foolproof ridge, the outer side wall of the contact PCB module is provided with a foolproof groove, and the foolproof ridge rotates within the foolproof groove of the contact PCB module to determine a mounting position of the contact PCB module.

Preferably, the sensor mounting base further comprises a detachable waterproof plug, the mounting structure of the waterproof plug cover and the mounting structure of the sensor are the same, and the waterproof plug cover is configured to block the sensor base for protection when the sensor is not mounted.

Preferably, the sensor mounting base is capable of being mounted in an intermediate position of the illumination lamp or mounted at the periphery of the illumination lamp; and/or the sensor further comprises a sensor face shell matched with the sensor bottom shell, and a receiving space is formed between the sensor face shell and the sensor bottom shell; and/or the sensor further comprises an optical lens disposed within the receiving space; and the optical lens may be slab-shaped, hemispherical, or special-shaped.

Preferably, the sensor mounting base is fixedly connected onto the illumination lamp; or the sensor mounting base is detachably connected onto the illumination lamp.

In order to solve the above technical problems, the present invention further provides a sensor, wherein the sensor is detachably connected to a surface of a main body of an illumination lamp, the sensor is provided with a sensing module therein, and after detecting a trigger signal, the sensing module generates a corresponding electrical signal to control the ON or OFF of the main body of the lamp.

Compared with the prior art, the illumination lamp with the sensor and the sensor provided by the present invention have the following beneficial effects.

The illumination lamp with the sensor provided by the present invention omits not only the complicated mounting steps and complicated wiring manner of the traditional sensor, but also external wiring. The illumination lamp is artistic and practical. The solution realizes simple and convenient mounting, and blind-mate quick mounting and disassembly. High efficiency, safety and reliability are realized.

According to the illumination lamp with the sensor provided by the present invention, an electronic connecting part of the sensor and the illumination lamp does not require external wiring due to an innovative connecting manner of the telescopic conductive pins. The illumination lamp is not only artistic and light, but also has superior functions. By adopting a rotary plug-in structure, the mounting manner of the sensor and the sensor mounting base is convenient and quick, thereby realizing blind screwing, greatly reducing mounting, production, and application costs, and achieving very beneficial effects.

By the above solution, the telescopic conductive pins and the contact PCB module are connected by pressing contact conduction to realize the electrical connection between the sensor and the illumination lamp, thereby replacing a traditional cable. The electrical connection is completed while the sensor and the sensor base are mounted and connected; the mounting is convenient, there is no need to use the adapter bracket and cables, and the integrity is excellent.

Further, after being provided with the sensor mounting base, the illumination lamp is compatible with a variety of sensor devices and standard universal sensor interfaces. Corresponding functions can be realized by only replacing different types of sensors, such as a microwave sensor, an infrared sensor, a light sensor, a Bluetooth controller, a WIFI controller, an Internet of Things controller, as well as a smoke sensor, a fire sensor and a security camera and the like having a special purpose. The product has the advantages of standardized interfaces, quick assembling and disassembling, hot plugging, blind screwing, foolproof property and the like, thereby greatly improving the maximum utilization of peripheral components of the product, and facilitating the sustainable development of the product.

According to the illumination lamp with the sensor and the sensor, the traditional manufacturing manner is changed, and an existing mature information transmission technology is combined. The sensor mounting base is connected to external equipment in a hot plugging mounting manner. The sensor mounting base is taken as a standardized unified interface, and such design effectively increases the overall versatility. Meanwhile, different modules can be mounted in the sensor to realize the corresponding functions. The existing sensor structure can also be reshaped to manufacture the peripheral matching equipment with more functions.

In the present invention, due to the design of multiple sealing rings inside and outside the sensor mounting base, the overall sealing performance is better. The overall mounting manner is very compact, thereby effectively ensuring the reliability and stability of the product.

In the present invention, the structural design of the telescopic conductive pins is adopted, so that signal connection and power supply link are realized, a cable is emitted, interference is reduced, and defects of wire winding and trimming are avoided.

The illumination lamp with the sensor and the sensor provided by the present invention comprise a plurality of foolproof structure designs, and are provided with foolproof logos conductive to the improvement of user experience.

The sensor provided by the present invention also has the advantages of simple mounting, quick assembling and disassembling, a blind plugging and foolproof property, a low-voltage work ability, multi-purpose universal interfaces, high efficiency, safety and reliability.

REFERENCE SIGNS

Figure 1:
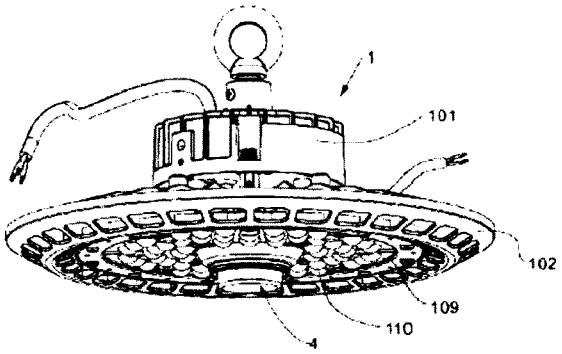
FIG. 1 is a schematic view of the overall structure of an illumination lamp with a sensor provided in a first embodiment of the present invention.

1—illumination lamp;
101—driving power supply;
102—heat radiator;
103—LED module;
1031—LED chip;
104—conductive copper column;
105—contact PCB module;
106—foolproof groove;
107—first contact surface;
107*b*—second contact surface;
107*c*—third contact surface;
107*d*—fourth contact surface;
107*e*—fifth contact surface;
108—fixing screw;
109—optical lens;
109*b*—optical lens;
110—optical lens spherical lens;
111—waterproof plug cover;
111*b*—waterproof plug cover;
2—sensor mounting base;
201—sensor mounting base side wall;
202—clamping block;
202*b*—clamping block;
203—waterproof ring extrusion arc surface;

204—initial positioning identifier;
205—locking positioning identifier;
4—sensor;
401—sensor bottom shell;
501—another embodiment of sensor bottom shell;
402—sensor bottom shell probe through hole;
403—first telescopic conductive pin;
403*b*—second telescopic conductive pin;
403*c*—third telescopic conductive pin;
403*d*—fourth telescopic conductive pin;
403*e*—fifth telescopic conductive pin;
404—through hole;
405—foolproof ridge;
406—angular slot;
407—clamping slot;
410—waterproof ring;
411—fixing column;
412—waterproof ring clamping slot;
413—sensor main board;
414—telescopic conductive pin bonding pad hole;
415—first module bonding pad hole;
416—second module bonding pad hole;
417—conversion circuit and temperature control module;
418—fixing hole;
419—sensing module;
419*a*—microwave sensing module;
419*b*—infrared sensing module;
419*c*—light sensing module;
419*d*—Bluetooth module;
419*e*—WIFI module;
419*f*—Internet of Things module;
419*g*—smoke sensing module;
419*h*—fire sensing module;
419*i*—camera monitoring module;
419*j*—temperature sensing temperature control module;
420—sensor waterproof sealing ring;
421—interference protecting ring;
422—sensor face shell;
522—another shape of sensor face shell;
622—another shape of sensor face shell;
623—optical lens;
624—optical lens waterproof ring;
625—optical lens pressure ring;
426—sensor face shell fixing screw;
628—optical lens pressure ring fixing screw;
431—connecting portion;
500—weld leg of Bluetooth module 419*d;*
7—sensor;
7*b*—sensor part of sensor;
701—sensor base sealing ring;
702—sensor base;
705—sensor base clamping slot;
706—sensor bottom shell mounting identifier;
707—sensor waterproof sealing ring;
708—sensor inner cover;
709*a*—supporting block
709*b*—limiting block
710—sensor face shell;
711—clamping block;
712—sensor face shell main board mounting buckle;
713—sensor face shell main board positioning column;
8—sensor;
801—sensor fixing nut;
802—sensor waterproof gasket;
803—sensor base;
804—sensor base clamping block;
805—contact PCB module;
806—contact PCB module fixing screw;
807—sensor main board;
808—sensor waterproof ring;
809—sensor face shell;
810—sensor face clamping slot;
9—mining lamp; and
10—illumination lamp.

DETAILED DESCRIPTION

In order to make the technical solutions and advantages of the present invention more clear, the present invention will be further described in detail below with reference to the accompanying drawings and embodiments. It should be understood that the specific embodiments described herein are merely illustrative of the present invention and are not intended to limit the present invention.

Figure 2:
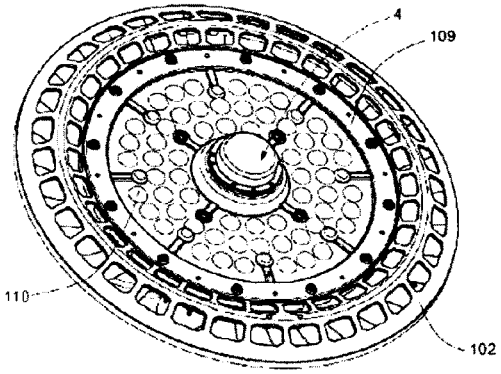
FIG. 2 is an isometric schematic view of the overall structure of the illumination lamp with the sensor provided in the first embodiment of the present invention.
Figure 3:
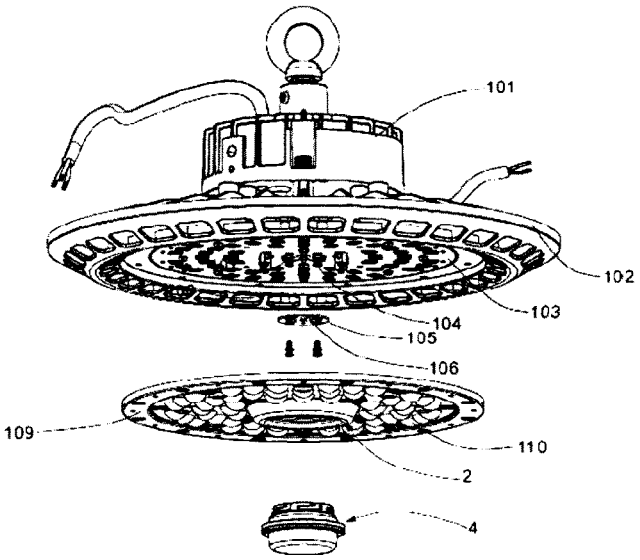
FIG. 3 is a partial structural exploded schematic view of the illumination lamp with the sensor provided in the first embodiment of the present invention.

Referring to FIG. 1 to FIG. 3, the first embodiment of the present invention provides a sensor and an illumination lamp with the same. The illumination lamp with the sensor comprises the illumination lamp 1, a sensor mounting base 2, and the sensor 4. The sensor mounting base 2 is integrated and injection-molded onto an optical lens 109 of the illumination lamp. The sensor 4 is detachably connected to the integrated sensor mounting base 2 in the optical lens 109. Specifically, in some embodiments, the detachable connection manner may be plug-in connection.

In combination with FIG. 2 and FIG. 3, the illumination lamp 1 is provided with the sensor mounting base 2, the sensor 4 can be detachably connected with the sensor mounting base 2, and the sensor 4 is directly connected to the sensor mounting base 2.

As shown in FIG. 3, in the embodiment, the illumination lamp 1 has an illuminating function. The illumination lamp 1 is composed of a driving power supply 101, a heat radiator 102, an LED module 103, an optical lens 109, and the like. The driving power supply 101 is provided with a dimming module therein, and the driving power supply 101 can control the brightness and ON and OFF of the illumination lamp 1. The LED module 103 is mounted on the radiator 102 of the illumination lamp.

Specifically, the middle position of the LED module 103 has a wire (not labeled), a terminal (not labeled), a copper column bonding pad (not labeled), a wire through hole (not shown), and the like. LED chips 1031 are fit-mounted on the outer circumference of the LED module 103. The conductive copper column 104 is welded to the LED module 103 by a reflow welding process.

As can be seen in conjunction with FIG. 4, FIG. 5, FIG. 6, and FIG. 7, the sensor 4 is mounted at the most intermediate position of the sensor bottom shell 401 facing the sensor mounting base 2. The sensor mounting base 2 is further provided with a contact PCB module 105 therein, and the sensor mounting base 2 has a plug-in interface structure. A circuit of the sensor mounting base is connected to a control line of the driving power supply 101, and the sensor mounting base 2 provides a universal interface for external equipment.

One end of the sensor 4 toward the contact PCB module 105 is provided with a telescopic conductive pin 403. The contact PCB module 105 is fixed to the conductive copper column 104 by a screw. The conductive copper column 104 guides the circuit on the illumination lamp 1 to the contact PCB module 105, and also plays a role of fixing the contact PCB module 105. The surface of the contact PCB module 105 is provided with a plurality of contact surfaces (not labeled), certain ends of these contact surfaces are electrically connected to the illumination lamp, and the other ends thereof are configured to be in electrical contact with the telescopic conductive pin 403 to achieve the purpose of electrical conduction.

Figure 6:
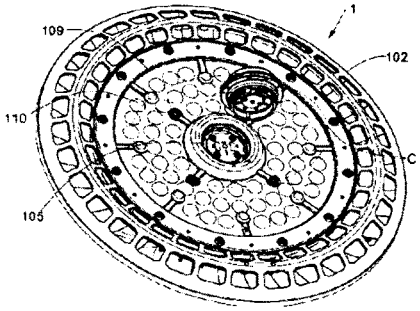
FIG. 6 is a schematic view showing that the sensor is separated from the illumination lamp with the sensor provided in the first embodiment of the present invention.
Figure 7:
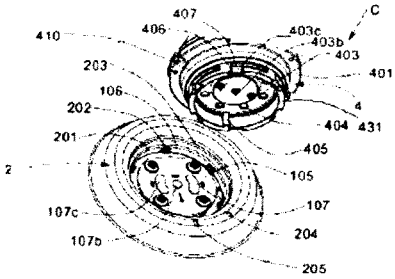
FIG. 7 is a partial enlarged view of the portion C shown in FIG. 6.

As shown in FIG. 6 and FIG. 7, the sensor mounting base 2 is a circular hole-shaped inserting slot, and a plurality of clamping blocks 202 are disposed on the wall surface of the sensor mounting base 2. In the present embodiment, the wall surface of the sensor mounting base 2 is circumferentially and uniformly provided with a plurality of clamping blocks 202.

It should be noted that the clamping block 202 is equivalent to a connecting boss disposed on the wall surface of the sensor mounting base 2, and the telescopic conductive pin 403 is equivalent to a positive electrode probe, a negative electrode probe, or a signal probe.

As shown in FIG. 7, the sensor 4 comprises the sensor bottom shell 401, and the sensor bottom shell 401 may further comprise a connecting portion 431 matched with the sensor mounting base 2. Specifically, the connecting portion 431 comprises a plurality of clamping slots 407 uniformly disposed along the circumferential direction of the connecting portion 431 at intervals, and the plurality of clamping slots 407 define a lamp mounting cavity.

As shown in FIG. 7, the outer side wall of the contact PCB module 105 is provided with a foolproof groove 106, and the foolproof ridge 405 rotates within the foolproof groove 106 of the contact PCB module 105 to determine the mounting position of the sensor 4 on the contact PCB module 105.

Figure 4:
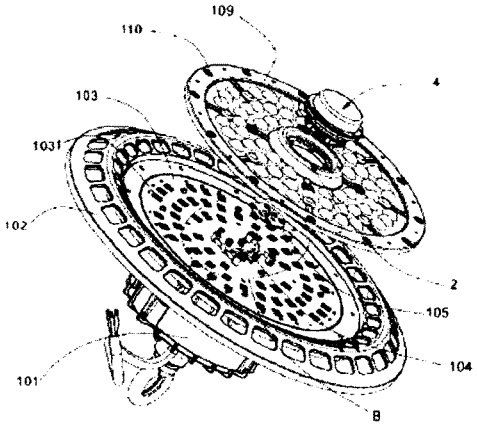
FIG. 4 is a partial isometric exploded schematic view of the illumination lamp with the sensor provided in the first embodiment of the present invention.
Figure 5:
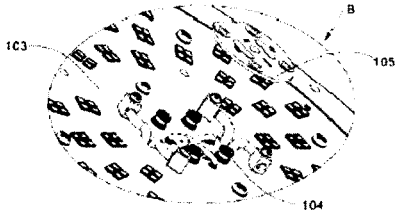
FIG. 5 is a partial enlarged view of the portion B shown in FIG. 4.

As shown in FIG. 3 and FIG. 4, the illumination lamp 1 further comprises an optical lens 109. After the optical lens 109 is mounted on the heat radiator 102 of the illumination lamp, the intermediate contact PCB module 105 is exposed. As shown in FIG. 3 and FIG. 4, and the optical lens 109 is disposed on the light emitting surface of the LED module 103, and is bulging on the light emitting surface.

Figure 8:
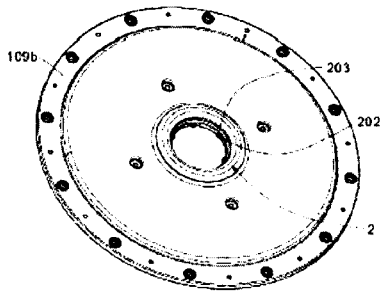
FIG. 8 is an isometric view of a planar optical lens of the illumination lamp with the sensor provided in the first embodiment of the present invention, and shows another embodiment of the optical lens 109.

As shown in FIG. 8, in other embodiments of the present invention, the illumination lamp 1 comprises an optical lens 109*b*. The optical lens 109*b* may also directly adopt a planar light-transmitting plate. The light-emitting angle through the optical lens 109*b* is 120° to form a uniform illuminating effect.

As shown in FIG. 8, the sensor mounting base 2 is disposed within the optical lens 109*b*, and the sensor mounting base 2 comprises a waterproof ring extrusion arc surface 203. The waterproof ring extrusion arc surface 203 is provided with a clamping block 202 therein.

Figure 9:
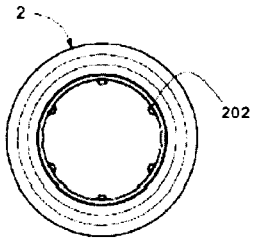
FIG. 9 is a partial schematic structural view of a sensor mounting base provided in a second embodiment of the present invention.
Figure 10:
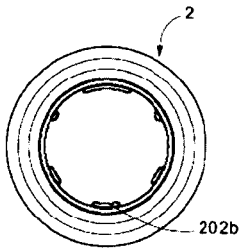
FIG. 10 is a partial schematic structural view corresponding to another embodiment of the sensor mounting base of FIG. 9.

In combination with FIG. 9 to FIG. 10, in the second embodiment of the present invention, the sensor mounting base 2 is disposed on the optical lens 109 or the sensor mounting base 2 may be fixed on the LED module 103. There are two arrangement manners for the clamping blocks 202 on the sensor mounting base 2. As shown in FIG. 9, the clamping blocks 202 on the sensor mounting base 2 are the same in size and are symmetrically distributed, which does not specifically require a specific mounting position. In the figure, six equal clamping blocks 202 are visible, and represent that the sensor 4 can be mounted from six angles respectively. Therefore, the limitation of such manner is small, and the multi-angle mounting is suitable for manufacturing external equipment without the need to distinguish a polarity of a conducting electron.

For example, the function of a wireless monitoring module can be realized by only taking power from the lamp, which just requires two positive and negative leading angles. The most intermediate position of the sensor 4 can be used as the power supply negative pole, and the two conductive pins on the sides are used as the positive poles, respectively. Therefore, the position differentiation is no longer needed. The correctness of electrical connection can be ensured by the mounting from any angle. The surveillance image has directional characteristics, if the illumination lamp cannot be rotated per se or the rotated position cannot meet the requirements, and an externally inserted monitor cannot be mounted at multiple angles, an inverted image and side image on a monitor screen will be caused. Only when the external module can be mounted at multiple positions, position debugging can be realized, so that the corresponding requirements can be met.

In the present invention, the equal and unequal attributes of the clamping slots 407 and the clamping blocks 202 determine the manner in which the sensor 4 is embedded. When the clamping slots 407 and the clamping blocks 202 are equal in angle and size, the sensor 4 can be mounted on the sensor mounting base 2 at the positions of different angles. When the clamping slots 407 and the clamping blocks 202 are not equal in angle and size, the sensor 4 can be mounted on the sensor mounting base 2 from only one absolute angle position.

In the present invention, in order to realize the convenience in mounting, the direction in which the sensor 4 and the sensor mounting base 2 are rotatably mounted or detached can be rotated counterclockwise or clockwise.

As shown in FIG. 7, for easy identification, an integrated sensor mounting base initial positioning identifier 204 and an integrated sensor mounting base initial positioning identifier 205 may be disposed on one surface of the sensor mounting base 2 where the contact PCB module 105 is disposed. Therefore, humanized reference identifiers can be conveniently disposed on the sensor, the LED module and the contact PCB module, respectively, which greatly facilitates the position identification. A process of assembling a waterproof plug cover 111 or waterproof plug cover 111*b* is just opposite to the disassembling process. The mounting can be completed by clockwise or counterclockwise screwing, and the waterproof plug cover 111 or the waterproof plug cover 111*b* has the same structural connection manner and sealing characteristics as the sensor bottom shell 401.

As shown in FIG. 7 and FIG. 10, buckles distributed on the sensor mounting base 2 are unequal in size, so that the sensor 4 is in a repelled state when not rotated to a specific position during mounting, thereby preventing the sensor 4 from being inserted. The position correctness is only indicated when the size and the position angle of the clamping block 202*b* and an angular slot 406 are in one-to-one correspondence, namely, the clamping block 202 falling into the clamping slot 406, so that the interference problem can be cancelled. Therefore, in the embodiment, the sensor 4 can be mounted at only one mounting angle, and the solution can achieve effective location and prevent wrong connection, and is particularly suitable for the sensor device, such as a microwave sensor, which performs electrical conduction and signal transmission simultaneously. The realization of this function requires not only taking power from the lamp but also acquiring and returning the signals. Such solution can better solve the problem of differentiation of the position and polarity, thereby effectively preventing the damage caused by wrong mounting.

In addition, in other embodiments, when the sensor 4 is mounted on the sensor base 2 at different angles, superior compatibility and modification characteristics can be achieved. When the sensor 4 is mounted on the sensor base 2 by only one absolute angle position, the sensor 4 has anti-error mounting characteristics, which can absolutely prevent the wrong mounting of the sensor 4.

Figure 11:
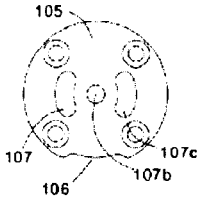
FIG. 11 is a schematic view of a circular contact surface and an arc-shaped contact surface on a contact PCB module provided in the present invention.
Figure 12:
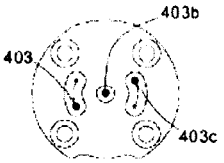
FIG. 12 is a schematic view of the contact between a contact PCB module and a telescopic conductive pin shown in FIG. 18.
Figure 13:
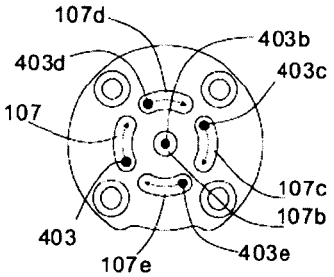
FIG. 13 is a schematic view of the contact between the contact PCB module corresponding to another embodiment and a telescopic conductive pin shown in FIG. 18.

Referring to FIG. 11 to FIG. 13, when the sensor 4 is mounted on the sensor mounting base 2, the telescopic conductive pin 403 of the sensor 4 is in contact with the contact PCB module 105, and the sensor 4 slides along the direction of an arrow as shown in the figure during rotating and mounting. A spring (not shown) is disposed in the telescopic conductive pin 403 to enable the telescopic conductive pin 403 to have certain elasticity, and the elastic telescopic conductive pin 403 can always maintain close contact with the contact surface of the contact PCB module 105. The telescopic conductive pin 403 can also effectively cancel the problem of contact failure during the vibration. The surface of the telescopic conductive pin 403 can also be gold-plated, and the contact surface of the contact PCB module 105 is tin-plated. An oxidation problem of contact components is effectively prevented by such technological processing manner, thereby making the contact structure more stable.

As shown in FIG. 7, FIG. 11 and FIG. 12, the first contact surface 107, the second contact surface 107*b*, and the third contact surface 107*c* on the contact PCB module 105 are corresponding to the first telescopic conductive pin 403, the second telescopic conductive pin 403*b* and the third telescopic conductive pin 403*c*. As shown in FIG. 7, when the rotation sensor 4 is mounted, the position of the second telescopic conductive pin 403*b* is unchanged, and the first telescopic conductive pin 403 and the second telescopic conductive pin 403*c* respectively perform circular motion in the R direction.

As shown in FIG. 10, a relative position between the clamping block 202*b* and the angular slot 406 varies along the circumference while the circular motion is performed. Based on such arrangement, the convenience of cooperation between the sensor 4 and the sensor mounting base 2 can be further improved, that is, based on such structural configuration, the sensor 4 can be fixed by screwing after being placed at multiple angles.

In order to make the contact area between the first contact surface 107, the second contact surface 107*b*, and the third contact surface 107*c* and the first telescopic conductive pin 403, the second telescopic conductive pin 403*b*, and the third telescopic conductive pin 403*c* larger, the shapes of the first contact surface 107, the second contact surface 107*b*, and the third contact surface 107*c* may be further defined.

As shown in FIG. 11 and FIG. 12, the second contact surface 107*b* has a circular contact surface, and each of the first contact surface 107 and the third contact surface 107*c* has a waist-shaped contact surface. In the process that the sensor 4 is inserted into the sensor mounting base 2 and rotated, the first contact surface 107 is always in contact with the first telescopic conductive pin 403, the second contact surface 107*b* is always in contact with the second telescopic conductive pin 403*b*, and the third contact surface 107*c* is always in contact with the third telescopic conductive pin 403*c*. That is, the curvatures of the contact surfaces of the first contact surface 107 and the third contact surface 107*c* correspond to the curvature of the angular slot 406, thereby ensuring that electrical connection can be realized regardless of whether the sensor 4 is screwed into place.

Further, the first telescopic conductive pin (positive electrode probe) 403, the second telescopic conductive pin (negative electrode probe) 403*b*, and the third telescopic conductive pin (signal probe) 403*c* are all elastic probes. When the sensor 4 is connected to the sensor mounting base 2, the first telescopic conductive pin (positive electrode probe) 403, the second telescopic conductive pin (negative electrode probe) 403*b*, and the third telescopic conductive pin (signal probe) 403*c* are compressed and generate the elastic restoring force accordingly, and thus tightly abut against respective contact surfaces respectively. Therefore, the formed electrical connection is more reliable. Meanwhile, the clamping block 202 and the clamping slot 407 form an elastic pressure. When being clamped into the clamping slot 407, first, the clamping block 202 must pass a vertical area. During rotation, the clamping block 202 actually moves in the clamping slot 407, and the sensor 4 is effectively prevented from rotating relative to the sensor base 2.

Referring to FIG. 11, FIG. 12 and FIG. 13, the first contact surface 107 is defined as a positive electrode contact, the second contact surface 107*b* is defined as a negative electrode contact, the third contact surface 107*c* is defined as a signal contact, the fourth contact surface 107*d* is defined as an additional signal positive electrode contact surface, and the fifth contact surface 107*e* is defined as an additional signal negative electrode contact surface. The signal acquisition and signal returning of the conductive pin also correspond to the functions of the contact surfaces one to one. The contact surface and the conductive pin are not fixed in definition, and can be changed in position and order to meet different needs. A meaning reference arrangement is only provided herein. The above additional signal positive electrode probe 403*d*/additional signal negative electrode probe 403*e*, and the like are not defined in a specific expression manner, and can be understood as an embodiment of the present invention, and the specific functions thereof can also be freely defined, and are not limited herein.

In the above embodiment, the contact PCB module as shown in FIG. 13 has five contact surfaces, which are the first contact surface 107, the second contact surface 107*b*, the third contact surface 107*c*, the fourth contact surface 107*d* and the fifth contact surface 107*e* respectively. Two standby signal transmission contact surfaces are added compared to the contact PCB module shown in FIG. 12, so that the external sensor 4 can realize more functions. According to the functional requirements, a variable number of telescopic conductive pins can be assembled, and the number of each of the contact surfaces and the telescopic conductive pins is at least three, and there is no restriction to the maximum number according to requirements.

Figure 14:
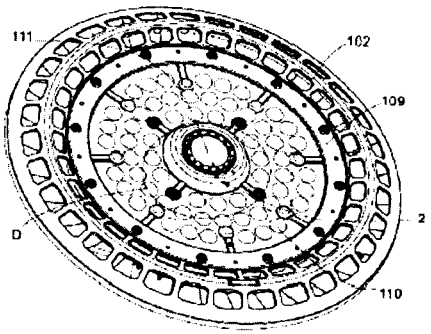
FIG. 14 is a schematic structural view of the illumination lamp with a sensor not provided with the sensor provided in a third embodiment of the present invention.
Figure 15:
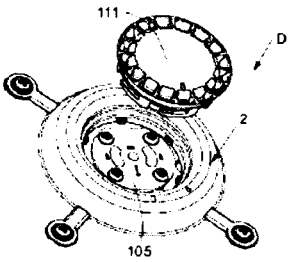
FIG. 15 is a partial enlarged view of a waterproof plug cover and the sensor mounting base in the embodiment shown in FIG. 14.
Figure 16:
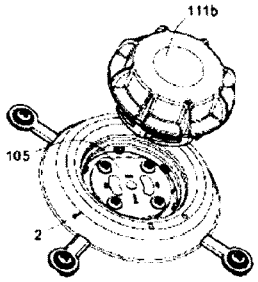
FIG. 16 is a partial enlarged view of a waterproof plug cover and the sensor mounting base in another embodiment shown in FIG. 14.

Referring to FIG. 14, FIG. 15, and FIG. 16, in the third embodiment of the present invention, a sensor 4 is provided. When the sensor device is not used, the waterproof plug cover 111 (as shown in FIG. 15) or the waterproof plug cover 111*b* (as shown in FIG. 16) can be used to block the sensor mounting base for protection. In order to mount the sensor, first, the waterproof plug cover 111 or the waterproof plug cover 111*b* needs to be removed. The waterproof plug cover 111 or the waterproof plug cover 111*b* can be pulled out as long as it cannot be rotated counterclockwise or clockwise.

The end surface of the waterproof plug cover 111 is provided with an adjusting groove, and the adjusting groove may be a groove in a straight shape, a cross shape, a flower shape, an inner hexagonal shape, an inner quadrangle shape, and the like. The waterproof plug cover 111 is rotated by the adjusting groove to enable the waterproof plug cover 111 to be connected to the sensor mounting base 2.

For example, the waterproof plug cover 111*b* shown in FIG. 16 protrudes from the sensor mounting base 2. The waterproof plug cover 111*b* is designed to protrude from the sensor mounting base 2. The waterproof plug cover 111*b* can be freely removed from the sensor mounting base 2 by hand for a better grip feeling and convenience in disassembly and mounting is realized.

As shown in FIG. 14, FIG. 15, and FIG. 16, when the sensor is not required to be connected, a docking groove (not labeled) can be connected to the waterproof plug cover 111. A connection structure of the waterproof plug cover 111 is the same as that of the sensor. In terms of the connection with the illumination lamp 1, the waterproof plug cover and the sensor are interchangeable. The illumination lamp 1 is provided with the waterproof plug cover 111 in the initial state, so that the function of protecting the docking groove can be realized. When the sensing function needs to be realized, a tool is required to take the waterproof plug cover 111 down.

Figure 17:
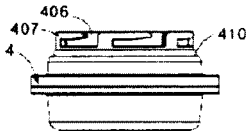
FIG. 17 is a schematic view of the overall structure of a sensor provided in a fourth embodiment of the present invention.
Figure 18:
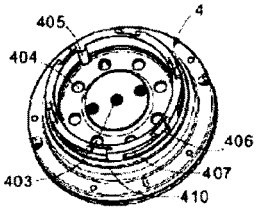
FIG. 18 is an isometric view of the overall structure of the sensor provided in the fourth embodiment of the present invention.

Further, in order to obtain a better waterproof effect, referring to FIG. 17 and FIG. 18, in the fourth embodiment provided by the present invention, the sensor 4 further comprises a sensor bottom shell waterproof ring 410 configured to seal the sensor base 4. After the sensor 4 is inserted into the base 2, the waterproof ring 410 just extrudes the waterproof ring extrusion arc surface 203. Another spare waterproof ring 410 can be assembled at the position 409 according to needs for double sealing.

Specifically, in order to achieve quick mounting, the positioning mounting can be quickly performed by referring to marks. Or, the sensor 4 can be rotated by 360° in the sensor mounting base 2 until the sensor 4 is rotated to a position where the sensor falls down significantly, is pressed with a slight force and is rotated clockwise simultaneously until it cannot rotate. Whether the sensor is rotated in place can be confirmed by referring to the locking positioning identifier 205 of the sensor mounting base 2. The waterproof ring 410 of the sensor bottom shell 401 tightly extrudes the waterproof ring extrusion arc surface 203 of the sensor base 2 after the mounting is completed, so that the illumination lamp 1 with a sensor forms a closed cavity for protection. Same as the disassembly of the waterproof plug cover 111, the sensor 4 is pulled out by rotating clockwise or counterclockwise until it cannot rotate any longer.

In the present embodiment, the sensor bottom shell 401 and the sensor bottom shell 501 (shown in FIG. 22) have the same function, but have a difference. The sensor bottom shell 401 can be mounted at multiple angles as described above, while the sensor bottom shell 501 has only one fixing position. The numbers of through holes for the telescopic conductive pins 403 are different. The sensor bottom shell 401 is used to be plugged and jointed with the sensor base 2, and all components of the sensor 4 are ultimately carried by the sensor bottom shell 401.

Figure 19:
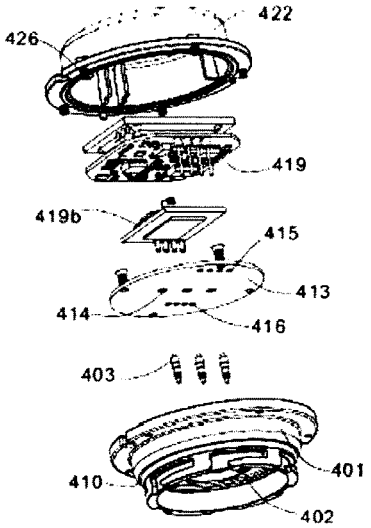
FIG. 19 is an exploded view of the overall structure of the sensor provided in the fourth embodiment of the present invention.

Referring to FIG. 18 and FIG. 19, in the present invention, the sensor 4 comprises at least one sensor main board 413 and a sensing module 419, and the sensing module 419 is triggered to transmit a control signal to the sensor main board 413. The control signal is then transmitted to the telescopic conductive pin 403 by the sensor main board 413, and the telescopic conductive pin 403 transmits the control signal to the illumination lamp 1 by the contact PCB module 105 in the sensor mounting base 2 to control the functions of the illumination lamp 1.

Specifically, the sensing module 419 comprises two modular circuits which are disposed in a superimposed manner. The modular circuits may specifically comprise a first circuit board 511 and a second circuit board 512. The first circuit board 511 can transmit more than two types of control signals at the same time. The first circuit board 511 can convert the detection signal into a voltage signal, and the second circuit board 512 receives the voltage signal and then sends a control signal to the lamp main body 501.

The control signal is generated after the sensing by the sensing module 419. Referring to FIG. 19, the telescopic conductive pin 403 is welded to the sensor main board 413 by welding. The elastic head of the telescopic conductive pin 403 is in contact with the contact surface of the contact PBC module 105 to form conduction, and the control signal is transmitted to the sensor main board 413.

As shown in FIG. 19, the sensor main board 413 is provided with a telescopic conductive pin bonding pad hole 414 allowing the telescopic conductive pin 403 to be inserted. The sensor main board 413 further comprises a first module bonding pad hole 415 and a second module bonding pad hole 416. The first module bonding pad hole 415 and the second module bonding pad hole 416 allow the sensing module 419 and the Bluetooth module **419*d*** to be inserted and fixed correspondingly.

As shown in FIG. 19, a Bluetooth module **419*d* is welded on the sensor module 413. In FIG. 19, a sensing module 419 is welded on the sensor main board 413. Both modules are inserted into the sensor main board 413 in the manner of an array and then firmly soldered, and are respectively inserted into the module welding holes of the sensing module 419 and the second module bonding pad hole 416. The functions of the sensing module 419 and the second module bonding pad hole 416 relate to extension of the function modules, and thus, the order of the two modules can also be changed. The Bluetooth module 419*d* and the sensing module 419 can also exist at the same time, and can be stacked in a laminating manner without interfering each other; or, only one module exists. In the figure, the conversion circuit and temperature control module 417** is shown as a conversion circuit and temperature control module, can have the functions of the conversion circuit and the temperature control circuit, and of course, can also be other circuits.

It should be particularly noted that the present invention comprises a temperature control module on the illumination lamp 1. The temperature of the illumination lamp 1 is detected in real time. When the temperature of the illumination lamp 1 approaches a limit value, the temperature control module lowers the output power of the lamp by 0-10V signals, and controls the temperature of the lamp 1 to be not larger than the limit value. When the ambient temperature is greater than 45° C.-50° C., the lamp output power is inversely proportional to the ambient temperature, while the temperature of the illumination lamp 1 is proportional to the ambient temperature change.

In order to avoid the irreversible damage to the illumination lamp 1 when an abnormally high temperature occurs in the use environment, and to increase the cost performance of the illumination lamp 1, the temperature control module is additionally mounted on a lamp panel of the illumination lamp 1.

In the present invention, the protection mechanism of the temperature control module is not a conventional switch protection mode, and the constant temperature control is realized by continuous temperature recognition and determination, as well as the operation of a compensation circuit. Since the switch operation is not directly used, flicker of the illumination lamp 1 is avoided.

Further, as shown in FIG. 19, after the sensor 4 is inserted into the illumination lamp 1, the telescopic conductive pin 403 is in contact with the contact PCB module 105 to be connected to the circuit of the sensor main board 413. Thus, the sensor main board 413 transmits the electronic signal of the illumination lamp 1 to the conversion circuit and temperature control module 417, and the conversion circuit and temperature control module 417 conducts the electronic signal to the first module bonding pad hole 415 or the second module bonding pad hole 416. The sensing module 419 acquires the signal and power from the first module bonding pad hole 415. At this point, the sensing module 419 already works. After the detector of the sensor module 419 is triggered, the sensing module 419 outputs the electronic signal and returns to the illumination lamp through the original path for control.

Figure 20:
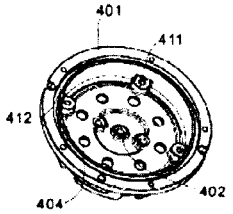
FIG. 20 is a schematic structural view of a bottom shell of the sensor provided in the fourth embodiment of the present invention.

As shown in FIG. 20, the sensor bottom shell 401 is further provided with a fixing column 411 for mounting and fixing the sensor main board 413. The sensor bottom shell 401 is further provided with a sensor bottom shell probe through hole. 402. The sensor bottom shell probe through hole 402 not only can be penetrated by the telescopic conductive pin 403, but also can protect the telescopic conductive pin 403 from the problems such as deformation and collision. In addition, the sensor bottom shell 401 is further provided with screw holes (not labeled) fixed to the sensor face shell 422 and a waterproof ring clamping slot 412. The sensor waterproof sealing ring 420 is mounted in the waterproof ring clamping slot 412 and is mainly used for sealing a joint at the sensor face shell 422. One end of the telescopic conductive pin 403 is welded to the sensor main board 413, and the other end thereof has an elastic rounded pin head for being in contact with the contact PCB module 105 for realizing conductive electronic connection. The sensor main board 413 is an electronic hub of the sensor 4. The telescopic conductive pin 403 and the sensor module 419 are both mounted on the sensor main board 413. The sensor main board 413 may also be provided with a conversion circuit, a temperature control module and the like. The specific type of the sensing module 419 may be changed according to functional requirements. Each module has a unique function and is a key component for determining the use of the sensor 4.

Figure 21:
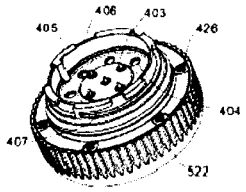
FIG. 21 is a schematic structural view of a sensor provided in a fifth embodiment of the present invention from another perspective.
Figure 22:
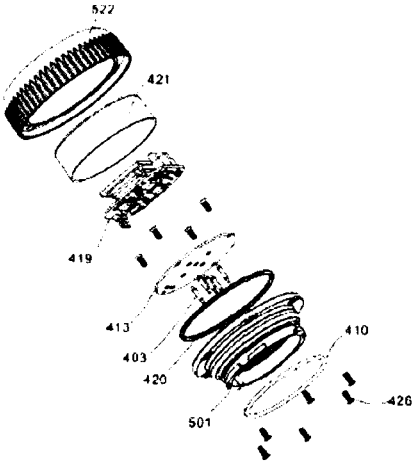
FIG. 22 is an exploded view of the overall structure of the sensor provided in the fifth embodiment of the present invention.

Referring to FIG. 21 and FIG. 22, in a fifth embodiment of the present invention, a sensor 4 is provided. The sensor 4 is different from the sensor 4 disclosed in FIG. 18 and FIG. 19 in that the number of the telescopic conductive pins 403 is five.

Specifically, as shown in FIG. 21 and FIG. 22, the sensor 4 further comprises an interference protecting ring 421. Such component is not a component that must be used, can be mounted or not according to the function requirements specifically, and may be made of opaque plastic or metal. The component is used for shielding external signal interference and light interference of the lamp. For example, when the light sensor is made, the component needs be used to shield the light from the self-illumination of the lamp. The interference protecting ring 421 is nested inside the sensor face shell 522. The sensor face shell 522 can be used to cover the sensor module 419.

Figure 23:
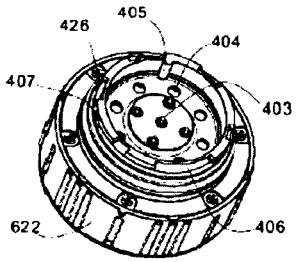
FIG. 23 is a schematic structural view of a sensor provided in a sixth embodiment of the present invention from another perspective.
Figure 24:
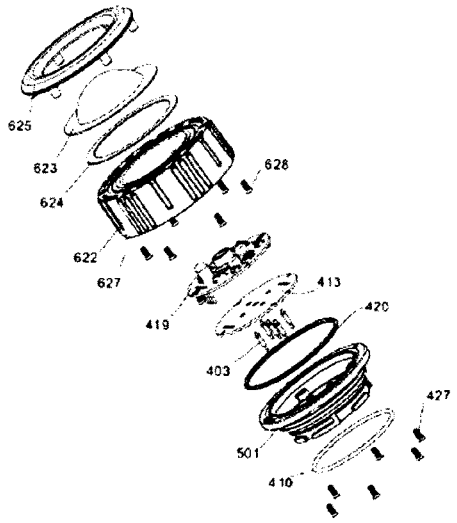
FIG. 24 is an exploded view of the overall structure of the sensor provided in the sixth embodiment of the present invention.

Further, in conjunction with FIG. 23 and FIG. 24, the sensor 4 is further disclosed in the sixth embodiment of the present invention. In the sensor 4, the sensor face shell 622 may have different shapes. In addition, a structure in which an optical lens 623 can be additionally mounted is also disposed in the middle of the sensor face shell 622. Different material requirements are required on the sensor face shell 622 sometimes, and the process of combining the two materials into one component is difficult. But, the combination of the two materials becomes easier by this assembling structure.

As shown in FIG. 23, a plurality of through holes 404 is disposed in the sensor bottom shell 401, and may serve as mechanical screw fixing holes or vent holes. Further, a plurality of foolproof ridges 405 is further disposed inside the sensor bottom shell 401 to prevent the sensor 4 from being mistakenly placed into the sensor base 2.

As shown in FIG. 23, in order to better fix the sensor face shell 622 with the sensor bottom shell 501, the sensor 4 further comprises face shell fixing screws 426 therein. The face shell fixing screws 426 comprise a plurality of screws which are evenly distributed on the top or bottom of the circumference of the sensor 4. The face shell fixing screws 426 can be used to fasten the sensor face shell 622 and the sensor bottom shell 401.

As shown in FIG. 24, the sensor 4 further comprises an optical lens waterproof ring 624 for sealing treatment between the optical lens 623 and the sensor face shell 622. The optical lens 623 may be in the shape of a hemisphere or a flat plate. It is assumed that the sensor 4 is provided with a camera module for monitoring therein, and the sensor face shell 622 is made of a fully transparent material. On the one hand, the requirements are met, but other areas become transparent, which affects the appearance. If the opaque material is used, the camera is shielded from capturing external images. Here, the processing of the local material becomes very important, so the optical lens 623 plays the role of changing the local optical properties of the sensor face shell 622.

As shown in FIG. 24, the sensor 4 further comprises an optical lens pressure ring 625 which plays a role of compressing the optical lens 623. The bottom of the optical lens pressure ring 625 is provided with a plurality of columnar structures (not labeled). The columnar structures are directly inserted into corresponding holes of the sensor face shell 422, and are fixed inside the sensor face shell 622 via optical lens pressure ring fixing screws 628. Of course, buckle structures can also be used so as to avoid the use of screws.

Referring to FIG. 25, FIG. 26, FIG. 27 and FIG. 28, in the seventh embodiment of the present invention, the sensor 4 is provided, and the sensor 4 may be structurally connected to the sensor base 2 in a plug-in manner. The electrical conduction forms electrical connection by the contact between the contact PCB module 105 and the telescopic conductive pin 403, so that the electrical conduction is completed while the sensor 4 is mounted, and no additional wiring is required. The sensor main board 4 is provided with a sensor main board 413 therein. The sensor main board 413 has functions of circuit conversion and module extension. A sensor module 419 is welded on the sensor main board 413. The sensor main board 413 is a communication bridge between the sensor 4 and the sensor module 419.

Figure 25:
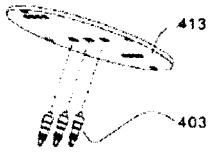
FIG. 25 is a welding position relationship diagram of a sensor main board and telescopic conductive pins in a sensor provided in a seventh embodiment of the present invention.

Referring to FIG. 25, in the embodiment of the present invention, the telescopic conductive pin 403 is connected to the bottom of the sensor main board 413 by high temperature welding. The sensor main board 413 herein and described below may also be considered as a sensor sub board.

At this point, the above welding position plays the roles of fixing the telescopic conductive pin 403 and conducting, so that the telescopic conductive pin 403 and the circuit of the sensor mounting base 2 are electrically connected.

In some embodiments, the telescopic conductive pin 403 is made of metal copper, has good electrical conductivity and superior wear resistance, and is resistant to worn.

Figure 28:
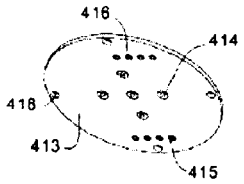
FIG. 28 is a structural diagram of a sensor main board in the sensor provided in the seventh embodiment of the present invention, wherein the sensor main board has five telescopic conductive pin bonding pad holes.

In order to enrich the functions of the sensor mounting base 2 in the embodiment of the present invention, in some embodiments, referring to FIG. 28, the second module bonding pad hole 416 of the Bluetooth module 419*d* may also be disposed in the sensor main board 413, and the sensor mounting base 2 may also comprise a Bluetooth module 419*d*. A weld leg 500 of the Bluetooth module 419*d* is inserted into the second module bonding pad hole 416.

In this way, the fixed conduction between the Bluetooth module 419*d* and the sensor main board 413 can be realized by high-temperature welding. With the Bluetooth module 419*d*, the lamp can be controlled by Bluetooth.

In some specific embodiments, the Bluetooth module 419*d* may select Hisense HD06VCRH-1, or other models.

Figure 26:
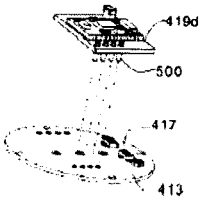
FIG. 26 is a welding position relationship diagram of the sensor main board and one of the sensor modules in the sensor provided in the seventh embodiment of the present invention.

Referring to FIG. 26, in order to improve the reliability of the connection between the sensor main board 413 and the Bluetooth module 419*d*, four second module bonding pad holes 416 are disposed in the sensor main board 413, and correspondingly, the Bluetooth module 419*d* is provided with four weld legs 500.

Figure 27:
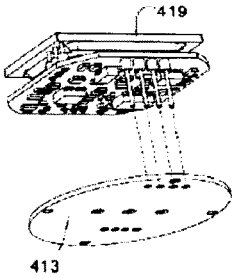
FIG. 27 is a welding position relationship diagram of the sensor main board and another sensor module in the sensor provided in the seventh embodiment of the present invention.

In other embodiments, referring to FIG. 27 and FIG. 28, the sensor main board 413 may be further provided with a first module bonding pad hole 415, the sensor mounting base 2 may further comprise a sensing module 419, and the sensing module 419 has a weld leg inserted into the first module bonding pad hole 415.

In this way, the fixed conduction between the sensing module 419 and the sensor main board 413 can be realized by high-temperature welding. With the sensing module 419, the lamp can be controlled by microwave.

It should be noted that the above Bluetooth module 419*d* and/or the sensing module 419 may be mounted on the sensor main board 413.

In addition, the Bluetooth module 419*d* and the sensing module 419 in the embodiment of the present invention are only illustrative. It can be easily conceived that other modules such as a WIFI module, a music playing module, or a GPS module can be connected to the sensor main board 413.

After the Bluetooth module 419*d*, the sensing module 419, and the like are mounted on the sensor main board 413, the Bluetooth module 419*d* and the sensing module 419 are in an upwardly protruding state. In order to prevent the interference with these modules, the upper shell 110 defines a cavity. The cavity is capable of accommodating these modules.

Figure 29:
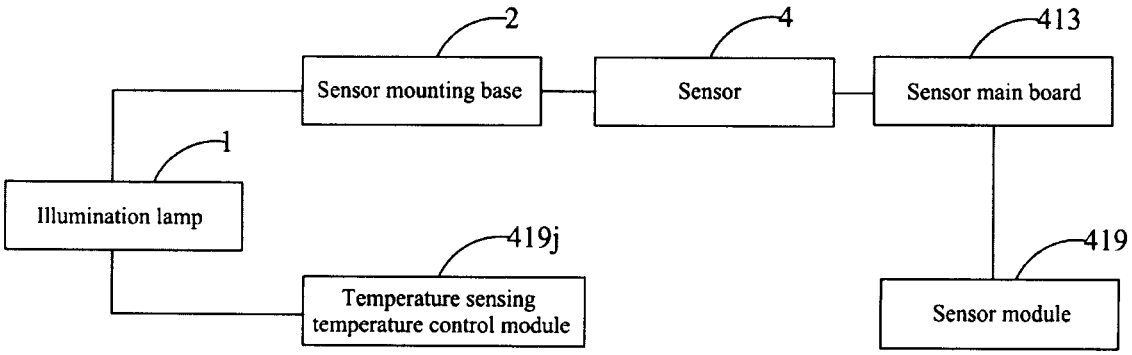
FIG. 29 is a schematic view of a combination relationship between the components of an illumination lamp with a sensor in the present invention.
Figure 30:
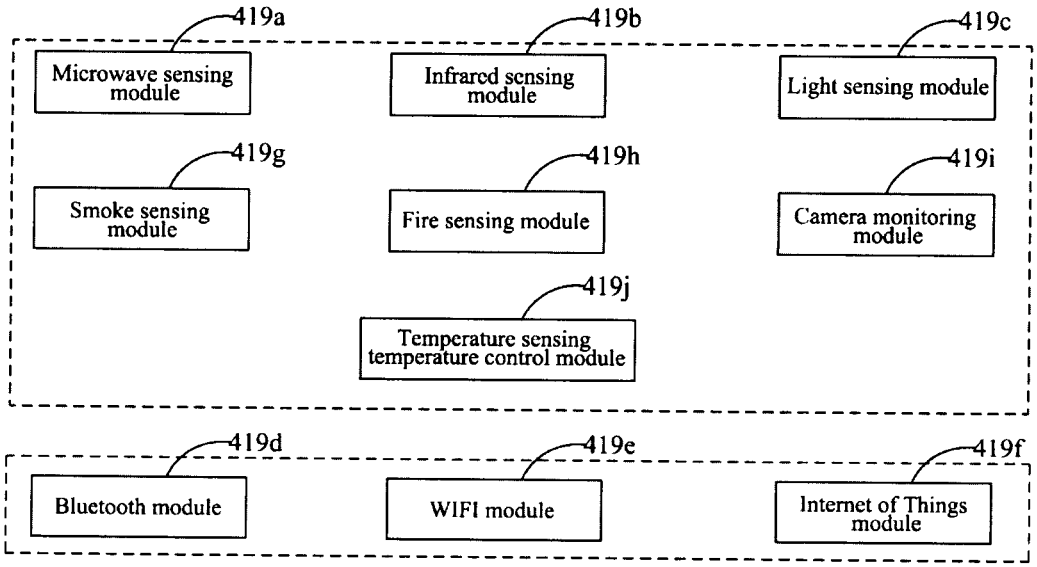
FIG. 30 is a partial example reference module diagram of several functional modules of the sensor module of FIG. 29.

As shown in FIG. 29 and FIG. 30, the illumination lamp with the sensor is formed by the illumination lamp 1, the sensor mounting base 2, and the sensor 4. In the structure shown in FIG. 29 and FIG. 30, the sensor mounting base 2 is integrally injection-molded on the illumination lamp 1. The illustrated temperature sensing temperature control module 419*j* may be integrated on the illumination lamp 1 or the sensor 4, and the illustrated sensor module 419 has several functions. The sensor 4 and the sensor module 419 are connected by the sensor main board 413.

As shown in FIG. 30, the sensor module 419 may further comprise a function module for sensing, such as a microwave sensing module 419*a*, an infrared sensing module 419*b*, a light sensing module 419*c*, a smoke sensing module 419*g*, a fire sensing module 419*h*, a camera monitoring module 419*i*, and a temperature sensing temperature control module 419*j*. The sensor module 419 further comprises functional modules for communication, such as a Bluetooth module 419*d*, a WIFI module 419*e*, and an Internet of Things module 419*f*. Each of the above functional modules has a unique function and use. In addition to the functional modules listed in FIG. 30, other modules, such as an air detecting module, a GPS module and an environment detecting module can be extended infinitely. The function extension of the illumining lamp can be realized by only replacing the sensor with different modules so as to achieve the corresponding functions.

The temperature sensing temperature control module 419*j* may be integrated on the illumination lamp 1 or integrated on the sensor main board 413 or welded to the module interface of the sensor main board 413 as a separate module.

Figure 31:
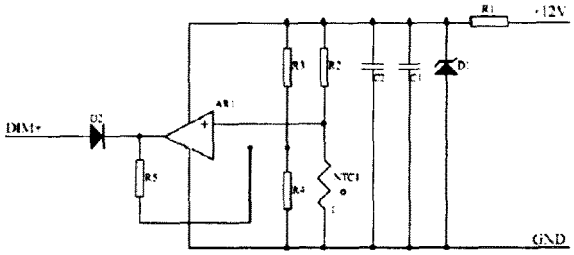
FIG. 31 is a schematic diagram of a temperature control circuit in an illumination lamp with a sensor in the present invention.

Specifically, as shown in FIG. 31, +12V of the circuit is connected to the LED-driven 12V auxiliary source positive electrode, the GND is connected to the LED-driven 12V auxiliary source negative electrode, and the DIM+ is connected to the LED-driven 0-10V dimming positive electrode. AR1 is a comparison amplifier and NTC1 is an NTC thermistor.

The relationship between the components in the circuit diagram is as follows.

One end of the resistor R1 is connected to the 12V input positive electrode, and the other end of the resistor R1 is connected to the voltage stabilizing diode D1, the capacitors C1 and C2, the resistors R2 and R3, and the power supply positive electrode of the comparator amplifier AR1. Certain ends of the capacitors C1 and C2 are connected to the resistor R1, and the other ends of the capacitors C1 and C2 are connected to the 12V input negative electrode. One end of the resistor R2 is connected to the resistor R1, and the other end of the resistor R2 is connected to the positive signal input IN+ of the comparator AR1 and NTC1. One end of the resistor R3 is connected to R1, and the other end of the resistor R3 is connected to the negative signal input IN− of the comparator AR1 and the resistor R4 and the resistor R5. One end of NTC1 is connected to the resistor R2 and the positive signal input IN+ of the comparator AR1, and the other end of NTC1 is connected to the 12V input negative electrode. One end of the resistor R4 is connected to the resistor R3, the resistor R5 and the negative signal input IN− of the comparator AR1, and the other end of the resistor R4 is connected to the 12V input negative electrode. One end of the resistor R5 is connected to the resistor R4, the resistor R3 and the negative signal input IN− of the comparator AR1, and the other end of the resistor R5 is connected to the comparator output OUT+ and the diode D2. One end of the D2 is connected to the 0-10V dimming positive DIM+, and the other end of the D2 is connected to the resistor R5 and the comparator AR1 output OUT+.

Specifically, the LED-driven 0-10V dimming interface outputs 100% when the input voltage is 10V, outputs 90% when the input voltage is 9V, and outputs 0% when the input voltage is 0V. That is, the input dimming voltage is linearly proportional to the output power, and the DIM+ of the high-temperature protection circuit is connected to the LED-driven 0-10V dimming to control the lamp output power.

It is set that the voltage of the positive signal input terminal of the comparator AR1 is Vin+, the voltage of the negative signal input terminal is Vin−, and the current flowing through the resistor R5 is 15, according to the principle of the closed-loop amplifying circuit, Vin+ is equal to Vin−, and the voltage of DIM+ is 12V*(R5*R4+NTC1*R4−NTC1)/(NTC1*R4+R2*R4).

The resistance of the NTC thermistor NTC1 will change with temperature. The higher the temperature is, the smaller the resistance is. According to the second point, it can be concluded that when NTC1 is greater than the resistor R4, DIM+ outputs the full voltage, and the lamp outputs power; when NTC1 is smaller than the resistor R4, DIM+ is reduced, the output power of the lamp is lowered, and the temperature of the lamp is reduced until the balance point. When the NTC thermistor NTC1 is less than ((R4*R5)/(R4+R5)), DIM+ is equal to 0, then the lamp is turned off.

Figure 32:
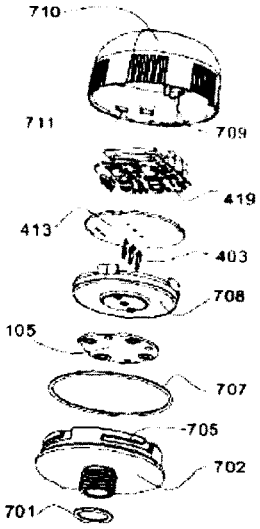
FIG. 32 is a schematic structural view showing an explosion state of a sensor provided in an eighth embodiment of the present invention.
Figure 33:
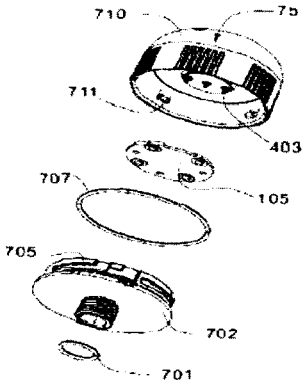
FIG. 33 is a schematic structural view showing partial explosion of the sensor provided in the eighth embodiment of the present invention.

Referring to FIG. 32 and FIG. 33, the eighth embodiment of the present invention provides an illumination lamp with a sensor, which is different from the illumination lamp with a sensor described in the above embodiments in that the illumination lamp with a sensor further comprises a sensor base 702 detachably connected to the illumination lamp 1. The sensor 4 comprises a sensor face shell 710 and a sensor module 419 mounted into the sensor face shell 710. The sensor further comprises a sensor main board 413 disposed on one side of the sensor base 702 facing the sensor 4. The sensor module 419 is provided with a telescopic conductive pin 403 electrically connected to the sensor main board 413.

It should be noted that the sensor face shell 710 is equivalent to the sensor shell, the sensor module 419 is equivalent to the sensing module, the telescopic conductive pin 403 is equivalent to a conductive probe, and the sensor main plate 413 is equivalent to an adapter structure.

The sensor module 419 comprises, but is not limited to, a pressure sensor, an infrared sensor, an ultrasonic sensor, a temperature sensor, a light sensor, and the like, which can be selected according to the suitability of the product.

In order to achieve the simple assembling effect, the sensor base 702 needs to select some convenient-to-disassemble connecting manners, so when being connected to external equipment, the sensor base 702 should adopt the relatively easy connection manner such as threaded connection, buckle connection, bolted connection, detachable hinge connection and magnetic attraction as much as possible. Optionally, the sensor base 702 is connected to the external equipment by threads.

Optionally, in order to cooperate with the design of different pieces of external equipment, the shape of the sensor face shell 710 may be a cylinder, a cube or a cuboid, etc.

A matching fixed structure is disposed between the sensor face shell 710 and the sensor base 702, and the sensor module 419 is electrically connected to the circuit in the external equipment by the sensor base 702.

Specifically, referring to FIG. 32, the sensor base 702 and the sensor face shell 710 are detachably connected. It can be understood that the same sensor module 419 can convert different signals. It can also be understood that the same product can be provided with different sensor modules 419 as needed, without the need to self-innovate the integrated device again, so that the manufacturing cost is greatly reduced while the overall design structure of the illumination lamp 1 is simplified, thereby achieving the characteristics of a wide range of applications, strong versatility and so on.

Figure 34:
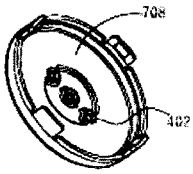
FIG. 34 is a schematic structural view of a sensor inner cover in the sensor provided in the eighth embodiment of the present invention.
Figure 35:
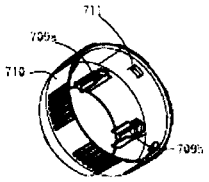
FIG. 35 is a schematic structural view of a sensor shell in the sensor provided in the eighth embodiment of the present invention.

Referring to FIG. 34 and FIG. 35, the inner wall of the opening of the sensor face shell 710 is further provided with supporting blocks 709*a* fixedly connected thereto and limiting blocks 709*b* with different structures. Two supporting blocks 709*a* and two limiting blocks 709*b* are disposed. The two supporting blocks 709*a* and the two limiting blocks 709*b* are annularly arranged at an interval, the limiting block 709*b* is C-shaped, the supporting block 709*a* is mountain-shaped, and each of the limiting block 709*b* and the supporting block 709*a* is provided with a flat portion. When the sensor module 419 is placed in the sensor face shell 710, the supporting blocks 709*a* and the limiting blocks 709*b* can play a role of supporting the sensor module 419, and the limiting blocks 709*b* can fully limit the degree of freedom of the sensor module 419. The two limiting blocks 709*b* have different sizes and openings, and can be used as foolproof structures in the mounting process of the sensor module 419. The supporting blocks 709*a* and the limiting blocks 709*b* are combined to form clamping slots.

Figure 36:
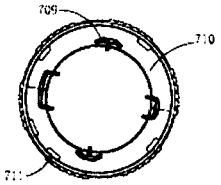
FIG. 36 is a bottom view of the sensor shell in the sensor provided in the eighth embodiment of the present invention.
Figure 37:
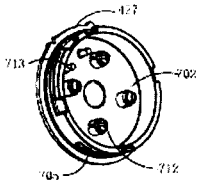
FIG. 37 is a schematic structural view of a sensor base of a sensing device in the sensor provided in the eighth embodiment of the present invention.
Figure 38:
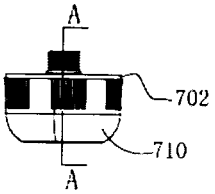
FIG. 38 is a bottom view of the sensor base in the sensor provided in the eighth embodiment of the present invention.

Referring to FIG. 36, FIG. 37 and FIG. 38, the inner wall of the opening of the sensor face shell 710 is provided with clamping blocks 711 with rectangular protrusions, and the sensor base 702 is provided with clamping slots 705 corresponding to the clamping blocks 711 in position and size. Five clamping blocks 711 are disposed in the embodiment, wherein four of the clamping blocks are arranged at the periphery in an annular matrix, and the last one clamping block is arranged separately. The corresponding clamping slots 705 are also correspondingly arranged according to such a manner, and the clamping slots 705 are designed in an L shape. When being embedded in the clamping slots 705, the clamping blocks 711 can be rotated and deadlocked, and the clamping block 711 which is separately arranged is used as the second foolproof structure when the sensor face shell 710 and the sensor base 702 are mounted. If the sensor face shell 710 needs to be removed from the sensor base 702, the sensor face shell 710 is only required to be pulled out after reverse rotation. The design is convenient and reliable, and the reliability is extremely strong.

It should be particularly noted that the clamping block 711 is equivalent to the first connecting block, and the clamping slot 705 is equivalent to the second limiting slot.

Referring to FIG. 33 and FIG. 37, the sensor base 702 is further provided with four connecting columns 713 and two limiting columns 712. The sensor main board 105 is provided with holes (not labeled) corresponding to the limiting columns 712 in position and size.

In combination with FIG. 32, FIG. 33, FIG. 38 and FIG. 39, from top to bottom, in the sensor base 4, the sensor base 702 and the sensor face shell 710 are connected to form a cavity. The joint of the whole cavity is provided with a sensor waterproof sealing ring 707 to ensure the sealing property of the cavity, so that that the sensor module 419 is not affected by the outside world. Similarly, the sensor base sealing ring 701 is adopted at the joint between the sensor base 702 and the external device to ensure the connecting sealing property with respect to the outside. As a whole, the signal is transmitted to the sensor module 419 by the telescopic conductive pins 403, and the sensor module 419 is fixed and supported by the limiting blocks 709*b* and the supporting blocks 709*a*. The whole sensor 4 adopts the very compact connecting manner, and the reliability and stability of the body can be fully realized in the state of use.

The sensor base 702 is disposed to be one separate component to provide portable mobile mounting, and the base may be integrated in a fixed place. That is, the base structure is integrated on the existing lens. The base does not need to be additionally fixed.

The detachable sensor provided by the present invention has better mounting convenience, ½ hole can be formed in the place where the product is to be mounted, without the need of integrated investment, and respective advantages are realized.

Since all the functions of the existing products are integrated in a lamp holder, the existing products do not have function extension. The present invention provides a central sensor which can be easily disassembled. Different types of central sensors can be purchased by the customer according to the actual needs of the user, thereby realizing DIY configuration of the product. Therefore, various modules can be arranged in the structural shell to realize functions such as microwave, Bluetooth, infrared, light sensing, voice control, monitoring security and temperature control. A corresponding control circuit can be disposed in the central sensor or in the lamp holder.

Figure 40:
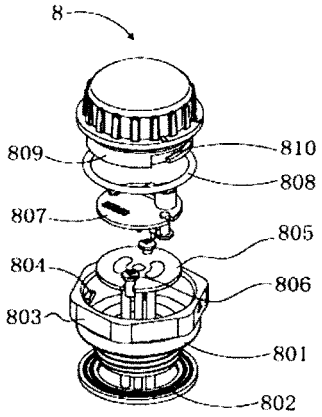
FIG. 40 is a schematic view showing an explosion state of a sensing device provided in a ninth embodiment of the present invention.

Referring to FIG. 40, in the ninth embodiment of the present invention, a sensor 8 is provided. Specifically, the sensor 8 comprises a sensor base 803 and a sensor face shell 809. The sensor base 803 is provided with clamping blocks 804. The sensor face shell 809 is provided with sensor face shell clamping slots 810 corresponding to the clamping blocks 804 of the sensor base in position and size, so that the sensor base 801 sleeves the sensor face shell 809. The sensor base 801 and the sensor face shell 809 form a cavity in which a sensor main board 807 is disposed. The sensor 8 comprises a contact PCB module 805 which is fixed on the sensor base 803 by contact PCB module fixing screws 806.

As shown in FIG. 40, the sensor 8 comprises a sensor waterproof ring 808 disposed between the sensor face shell 809 and the sensor base 803.

As shown in FIG. 40, the sensor base 803 is fixed on the illumination lamp (not shown) by the sensor fixing nuts 801. In order to achieve a better waterproof effect, sensor waterproof gaskets 802 are further disposed between the sensor fixing nuts 801 and the illumination lamp (not shown).

It should be noted that the sensor face shell 809 is equivalent to the sensor shell, the sensor main board 807 is equivalent to the adapter structure, and the sensor base clamping block 804 is equivalent to the first connecting block. The sensor face shell clamping slot 810 is equivalent to the second limiting slot, and the contact PCB module 805 is provided with a positive electrode contact, a negative electrode contact, a signal contact, and the like.

Figure 39:
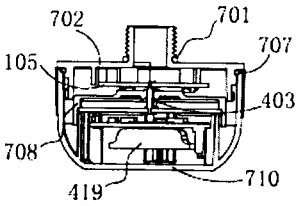
FIG. 39 is a schematic structural view showing an assembling state of the sensor provided in the eighth embodiment of the present invention.

Further, the sensor 8 shown in FIG. 39 is the smallest plug-in sensor of the present invention, and the implementation manner thereof is similar to the solution described above. Meanwhile, this plug-in has a corresponding solution improvement, which will not be repeated here.

Figure 41:
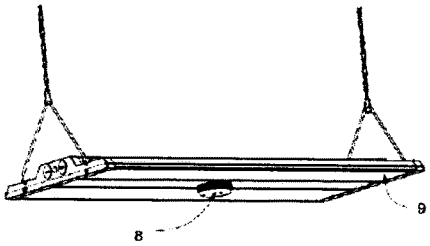
FIG. 41 shows another embodiment of an illumination lamp with a sensor provided in a tenth embodiment of the present invention.

Referring to FIG. 40 and FIG. 41, in the illumination lamp with the sensor provided by the tenth embodiment of the present invention, the sensor 8 may be disposed on the light emitting surface of a mining lamp 9, and specifically, the sensor 8 can be integrally formed or detachably connected with the mining lamp 9.

Figure 42:
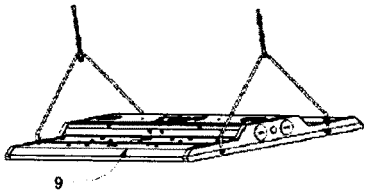
FIG. 42 is a schematic structural view of FIG. 41 from another perspective.
Figure 43:
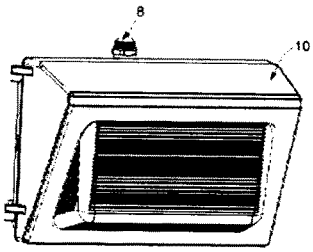
FIG. 43 shows yet another embodiment of an illumination lamp with a sensor provided in an eleventh embodiment of the present invention.
Figure 44:
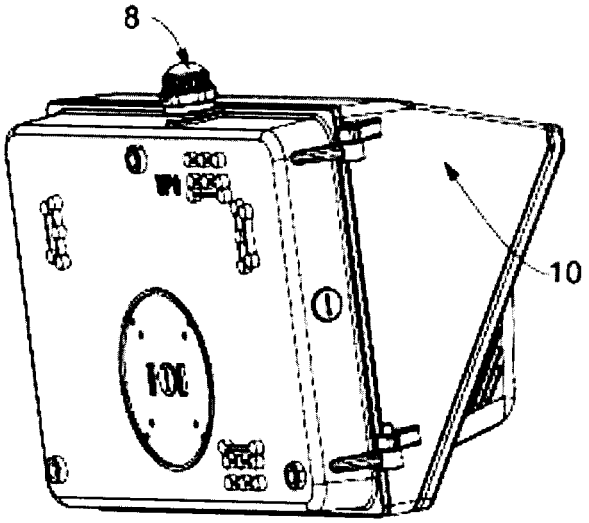
FIG. 44 is a structural schematic diagram of FIG. 43 from another perspective.

Further, as shown in FIG. 42 and FIG. 43, the sensor 8 provided by the eleventh embodiment of the present invention may be disposed above the illumination lamp 10. The sensor 8 is disposed on the edge of the illumination lamp 10. The sensor 8 may be connected to the illumination lamp 10 by a plug-in structure, is mainly used for reforming and upgrading the existing products, and can also be applied to new products. For the mounting of the sensor 8, only a ½ hole needs to be formed in the illumination lamp 10, and the hole site of the ½ hole is the specification of a reserved hole commonly used in existing lamps. A sensing module (not shown) is disposed in the sensor 8, and the sensing module generates a corresponding electrical signal after detecting the trigger signal to control the ON/OFF or other control modes of the illumination lamp 10.

It can be understood that the sensor provided by the present invention can be widely applied to a variety of illumination lamps, has wider applicability, and is constructed in a manner similar to that of the illumination lamp of the first embodiment of the present invention. Only the type of the illumination lamp and the mounting locations of the specific sensors are changed.

It should be understood that the sensor provided by the present invention can be applied to a strip lamp, a circular lamp, or an irregular lamp, and also has functions in other fields without departing from the scope of the embodiments of the present invention.

Compared with the prior art, the sensor and the illumination lamp with the same provided by the present invention have the following beneficial effects.

In the present invention, the sensor controls the light emitting of the illumination lamp by detecting the environmental signal, so that the illumination lamp can be automatically and intelligently controlled according to the external environment. The environmental signal may be various signals such as an ambient brightness signal, a sound signal, signals of people or objects nearby, an environmental quality signal and a smoke signal. The adjustment of the light emitting of the illumination lamp 1 may comprise the adjustment of brightness, light emitting color, sound signal and heat radiation signal (for example the infrared signal) and the like; the illumination lamp can be set according to the use environment and use requirements; and the type of the sensor is selected according to the type of the detected environmental signal.

It should be understood that the sensor may be configured to sense one type of environmental signal, or may be configured to sense a plurality of environmental signals. The light emitting of the illumination lamp with the sensor may also be set to the single adjustment of ON and OFF, or a plurality of light-emitting parameters can be adjusted according to different environmental signals.

It should be understood that the electrical connection manner between the sensor and the sensor mounting base or the illumination lamp is not limited to the contact connection manner of the telescopic conductive pin and the contact, and may also be spring-type connection, plug-in connection, pinhole link, magnetic connection, wireless coupling connection, etc. The sensor base is disposed to be a separate component to provide more portable mobile mounting, and the base can also be integrated in a fixed place for use. That is, the optical lens in the embodiment of the present invention has been integrated with the base structure, without the need to additionally dispose a base.

The sensor face shell has the roles of covering and protecting the internal circuit of the sensor, and the sensor face shell can be freely shaped to meet the requirements of extension mounting of more modules, beautify the appearance effect, and change the mounting grip feeling.

The optical lens may be in the shape of a flat plate, a hemisphere, an irregular shape or the like, is fixed on the sensor face shell by a pressure ring or an ultrasonic process and is used for changing the local optical characteristics of the sensor face shell. The characteristics may comprise light transmission, light concentrating, light scattering, light collection, light emitting and the like.

Since all the functions of the existing products are integrated into the illumination lamp, the existing products do not have function extension. The present invention provides the central sensor which can be easily disassembled, and different types of sensors can be purchased by the customer according to the actual needs of the user, thereby realizing the DIY configuration of the product. Therefore, various modules can be arranged in the structural shell to realize the functions such as microwave, Bluetooth, infrared, light sensing, voice control, monitoring security and temperature control. The corresponding control circuit may be disposed within the sensor or within the illumination lamp.

The above embodiments are merely illustrative of several embodiments of the present invention, are specifically described in detail and are not to be construed as limiting the scope of the present invention. It should be noted that a number of variations and modifications can be made by those skilled in the art without departing from the concept of the present invention, and these variations and modifications are within the scope of the present invention.

The illumination lamp with the sensor provided by the embodiment omits the complicated mounting steps and the complicated wire connecting manner of the traditional sensor. The solution achieves simplicity and convenience in mounting, blind plugging, quick assembling and disassembling, high efficiency, and high safety and reliability. The cost is greatly reduced while the sensing function is completely realized. The illumination lamp is easy to mount and maintain, has artistic overall appearance, and has a wide range of market applications.

The present invention provides the illumination lamp with the sensor. By the innovative connecting mode of the telescopic conductive pin, the design of the sensing part without an external cable can be realized, and the illumination lamp is not only artistic and light, but also has superior functions. The plug-in mounting structure of the sensor is convenient and quick in mounting, and can realize blind screwing, thereby greatly reducing the mounting cost and product cost. The sensor base acts as a unified universal interface, greatly improves the maximum utilization of product parts, is also conducive to the sustainable development of products, and achieves excellent effects.

The above is only the preferred embodiments of the present invention, and is not intended to limit the present invention. Any modifications, equivalent substitutions, and improvements made within the principles of the present invention should be within the protection scope of the present invention.

The invention claimed is:

1. An illumination lamp with a sensor, comprising: the illumination lamp, a sensor mounting base and the sensor, wherein the sensor mounting base is disposed on the illumination lamp, the sensor and the sensor mounting base are detachably mounted and connected, and the sensor generates a corresponding electrical signal after detecting a trigger signal to control the illumination lamp to perform a preset control operation;

the sensor mounting base is mounted in an intermediate position of the illumination lamp or at the periphery of the illumination lamp; and/or the sensor further comprises a sensor face shell matched with the sensor bottom shell, and a receiving space is formed between the sensor face shell and the sensor bottom shell; and/or the sensor further comprises an optical lens disposed in the receiving space; and the optical lens is slab-shaped, hemispherical, or irregular-shaped.

2. The illumination lamp with the sensor according to claim 1, wherein the sensor is provided with a telescopic conductive pin, the sensor mounting base is provided with a contact PCB module, the sensor and the sensor mounting base adopt plug-in connection, and the telescopic conductive pin and the contact PCB module are in pressing contact conduction to realize electrical connection.

3. The illumination lamp with the sensor according to claim 2, wherein the sensor comprises at least one modular circuit board, the modular circuit board comprises a sensing module, after being triggered, the sensing module transmits a control signal to a sensor main board, then the control signal is transmitted to the telescopic conductive pin by the sensor main board, and the telescopic conductive pin transmits the control signal to the illumination lamp by the contact PCB module in the sensor mounting base to realize function control.

4. The illumination lamp with the sensor according to claim 3, wherein the sensing module comprises any one or a combination of more of a microwave sensing module, an infrared sensing module, a light sensing module, a smoke sensing module, a fire sensing module, a camera monitoring module, a temperature sensing temperature control module, a Bluetooth control module, a WIFI control module, or an Internet of Things control module.

5. The illumination lamp with the sensor according to claim 1, wherein the illumination lamp with a central sensor comprises a temperature control module, and the temperature control module is integrated in the illumination lamp or disposed in the sensor; the temperature control module comprises a chip of a comparator and a thermistor, the resistance value of the thermistor changes according to a temperature change, the comparator realizes continuous temperature recognition by judging the resistance value of the thermistor, and when judging that the identification value deviates from a set value, the comparator sends the control signal to adjust power output of the illumination lamp.

6. The illumination lamp with the sensor according to claim 2, wherein at least three telescopic conductive pins are disposed, the single telescopic conductive pin comprises any one of a power supply positive electrode conductive pin, a power supply negative electrode conductive pin, a dimming signal positive electrode conductive pin, an auxiliary signal positive electrode conductive pin, and an auxiliary signal negative electrode conductive pin; and the contact PCB module is provided with at least three conductive contact surfaces, and the telescopic conductive pins are matched with the conductive contact surfaces.

7. The illumination lamp with the sensor according to claim 6, wherein the single conductive contact surface is circular or arc-shaped; and one of the plurality of conductive contact surfaces is located at a central position and is circular, and the other conductive contact surfaces are located in the circumferential direction with the central position as the center of a circle and are arc-shaped.

8. The illumination lamp with a sensor according to claim 2, wherein three telescopic conductive pins are disposed, and comprise a first telescopic conductive pin, a second telescopic conductive pin and a third telescopic conductive pin, the contact PCB module comprises a first conductive contact surface, a second conductive contact surface and a third conductive contact surface, the first telescopic conductive pin, the second telescopic conductive pin and the third telescopic conductive pin are arranged side by side in parallel, the first telescopic conductive pin is in pressing contact with the first conductive contact surface, the second telescopic conductive pin is in pressing contact with the second conductive contact surface, and the third telescopic conductive pin is in pressing contact with the third conductive contact surface; and the second conductive contact surface is circular, and the first conductive contact surface and the third conductive contact surface are both arc-shaped with the second conductive contact surface as the center of a circle.

9. The illumination lamp with the sensor according to claim 3, wherein the sensor main board is provided with two or more groups of through holes, the through holes are configured to allow sensing modules to be welded, and at least two sensing modules are welded and mounted on the sensing main board simultaneously.

10. The illumination lamp with the sensor according to claim 1, wherein the sensor comprises a sensor bottom shell, the side wall of the sensor bottom shell is provided with clamping slots, the side wall of the sensing mounting base is provided with clamping blocks, and the docking clamping slots are connected to the docking clamping blocks in a rotary plug-in manner; and the number of each of the clamping slots and the clamping blocks is at least two or more, and the clamping slots and the clamping blocks are the same or different in arrangement angle and size.

11. The illumination lamp with the sensor according to claim 10, wherein the inner side wall of the bottom shell of the sensor is provided with a foolproof ridge, the outer side wall of the contact PCB module is provided with a foolproof groove, and the foolproof ridge rotates in the foolproof groove of the contact PCB module to determine a mounting position of the contact PCB module.

12. The illumination lamp with the sensor according to claim 1, wherein the sensor mounting base further comprises a detachable waterproof plug cover thereon, the mounting structure of the waterproof plug cover and the mounting structure of the sensor are the same, and the waterproof plug cover is configured to block the sensor base for protection when the sensor is not mounted.

13. The illumination lamp with the sensor according to claim 1, wherein the sensor mounting base is fixedly connected onto the illumination lamp; or the sensor mounting base is detachably connected onto the illumination lamp.

* * * * *